US005228412A

United States Patent [19]

Bell

[11] Patent Number: 5,228,412

[45] Date of Patent: Jul. 20, 1993

[54] HARNESS WITH RAPPELLING STRAPS, POSITIONING PAD, AND TOOL BELT

[76] Inventor: Michael Bell, 1705 Triumphe Way, Warrington, Pa. 18976

[21] Appl. No.: 893,298

[22] Filed: Jun. 4, 1992

[51] Int. Cl.[5] ..... A62B 35/00

[52] U.S. Cl. ..... 119/96; 182/3

[58] Field of Search ..... 119/96; 244/151 R; 182/3, 4, 7; 224/259

[56] References Cited

U.S. PATENT DOCUMENTS

| | | | |
|---|---|---|---|
| 4,553,633 | 11/1985 | Armstrong et al. | 119/96 X |
| 4,687,074 | 8/1987 | Green | 182/3 |
| 4,923,105 | 5/1990 | Snyder | 224/259 X |
| 5,080,191 | 1/1992 | Sanchez | 182/3 |
| 5,131,490 | 7/1992 | Bell | 182/7 |

FOREIGN PATENT DOCUMENTS

PCT/US90/-
06609 11/1990 PCT Int'l Appl. .

*Primary Examiner*—Robert P. Swiatek
*Attorney, Agent, or Firm*—Caesar, Rivise, Bernstein, Cohen & Pokotilow, Ltd.

[57] ABSTRACT

A harness to be worn by a person located at an elevated position for releasable securement to a holding or lowering device to protect the person from falling. The harness is formed of interconnected webs of flexible, e.g., nylon, material. The harness includes a pair of extendable, flexible, rapelling straps for connection to the holding or lowering device. Each rapelling strap includes a passageway through which a waist belt extends to releasably secure it to the harness. The waist belt includes a positionable tool case thereon. A positioning pad may be releasably secured to the waist belt.

15 Claims, 4 Drawing Sheets

HARNESS WITH RAPPELLING STRAPS, POSITIONING PAD, AND TOOL BELT

BACKGROUND OF THE INVENTION

This invention relates generally to safety apparatus and more particularly to a harness arranged to be worn by a person to protect him/her from a fall.

As a result of the enactment of various safety laws persons working at elevated height positions, e.g., window washers, telephone lineman, etc., are required to be protected against falls. One common approach to achieve that end is the use of a safety belt which is worn on the worker's waist. The belt is arranged to be worn about the waist of the workman and includes a D-ring or some other metal loop fixedly mounted on the belt in the center of the portion located at the worker's back. The D-ring is arranged to be "tied off" i.e., connected, via a lanyard or some other means, to a supporting member, e.g., a portion of a building or other static structure, a rope grab device mounted on a safety line, etc. Thus, once the worker is tied off should he/she fall off the platform, scaffolding, or other support on which he/she is working or if that platform etc. itself drops or otherwise falls away, the worker will be prevented from falling to the ground.

While such safety belts are generally suitable for their intended purposes they are not designed to act as a primary means for suspending the person at an elevated position to enable him/her to perform some activity while so suspended. In fact such safety belts are generally incapable of such use since they tend to inhibit the person's mobility, thus interfering with the worker's ability to function efficiently when he/she is tied off.

Harnesses have been developed and sold to serve as a means to distribute the shock load across portions of the body of the wearer for fall protection purposes. Such harnesses typically include straps or loops which are arranged to encircle the wearer's thighs, a belt or some other portion to encircle the wearer's waist, and straps extending over the wearer's shoulders. Such harnesses typically also include at least one connection member, e.g., a D-ring, to enable the harness to be connected to some tie-off means for fall protection purposes.

One type of harness is that disclosed in conceding application Ser. No. PCT/US90/06609, the entire disclosure of which is incorporated by reference herein.

OBJECTS OF THE INVENTION

Accordingly, it is a general object of this invention to provide a harness which overcomes the disadvantages of the prior art.

It is a further object of this invention to provide a rappelling harness including a tool belt.

It is still a further object of this invention to provide a rapelling harness including a positioning pad.

It is yet a further object of this invention to provide a rapelling harness having a releasably securable tool belt and/or a releasably securable positioning pad.

SUMMARY OF THE INVENTION

These and other objects of this invention are achieved by providing a harness formed of a flexible material to be worn by a person, the harness includes a waist belt, a pair of upper torso straps, a pair of leg straps, and a pair of rapelling straps.

Each of the upper torso straps includes a chest strap portion for extending over a portion of the back of the person, a shoulder strap portion for extending over a respective shoulder of the person, and a back strap portion for extending over a portion of the back of the person. Each of the leg straps is arranged for extending about a respective leg of the person. Each of the rapelling straps is connected to a respective one of the leg straps and to a respective one of the chest straps.

Each of the rapelling straps includes an extendable portion arranged to be extended from a retracted position to an extended position for connection to a holding or lowering device. Each of the rapelling straps includes a passageway through which the waist belt extends to releasably secure the waist belt to the harness.

In accordance with one aspect of this invention the waist belt comprises a tool belt for slidably supporting a tool holder thereon.

In accordance with another aspect of this invention a positioning belt may be releasably secured to the waist belt.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
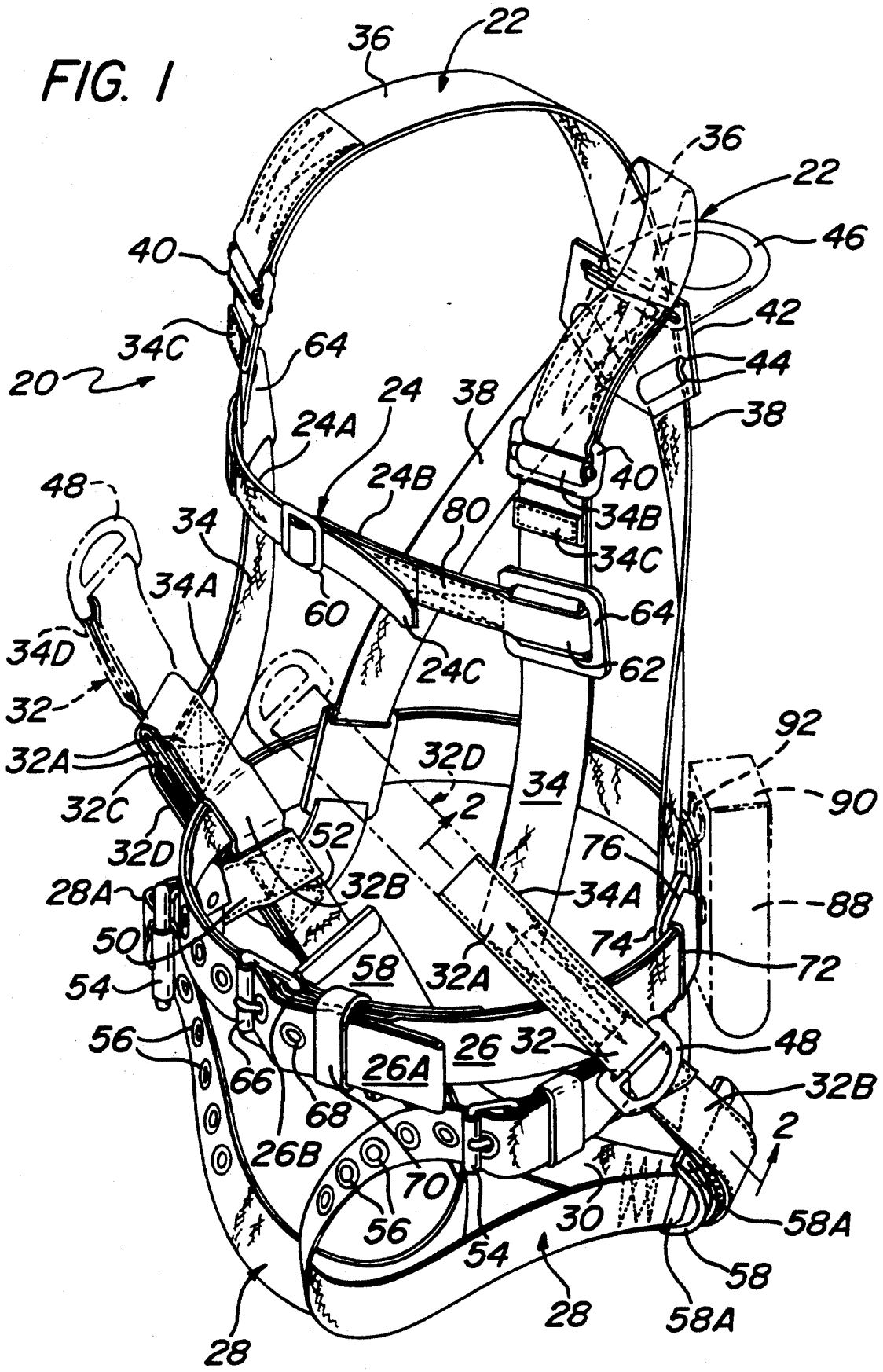
FIG. 1 is an orthogonal view of one embodiment of a harness constructed in accordance with this invention.

Referring now to various figures of the drawing where like reference numerals refer to like parts there is shown at 20 in FIG. 1, one embodiment of a harness constructed in accordance with this invention.

The harness 20 is arranged to be worn by the person to support/suspend him or her at an elevated position so that he or she can perform some activity thereat, substantially unencumbered or unhindered by the harness, or to connect to it any lowering device for rapelling purposes or to a tie off device for fall prevention purposes.

Figure 2:
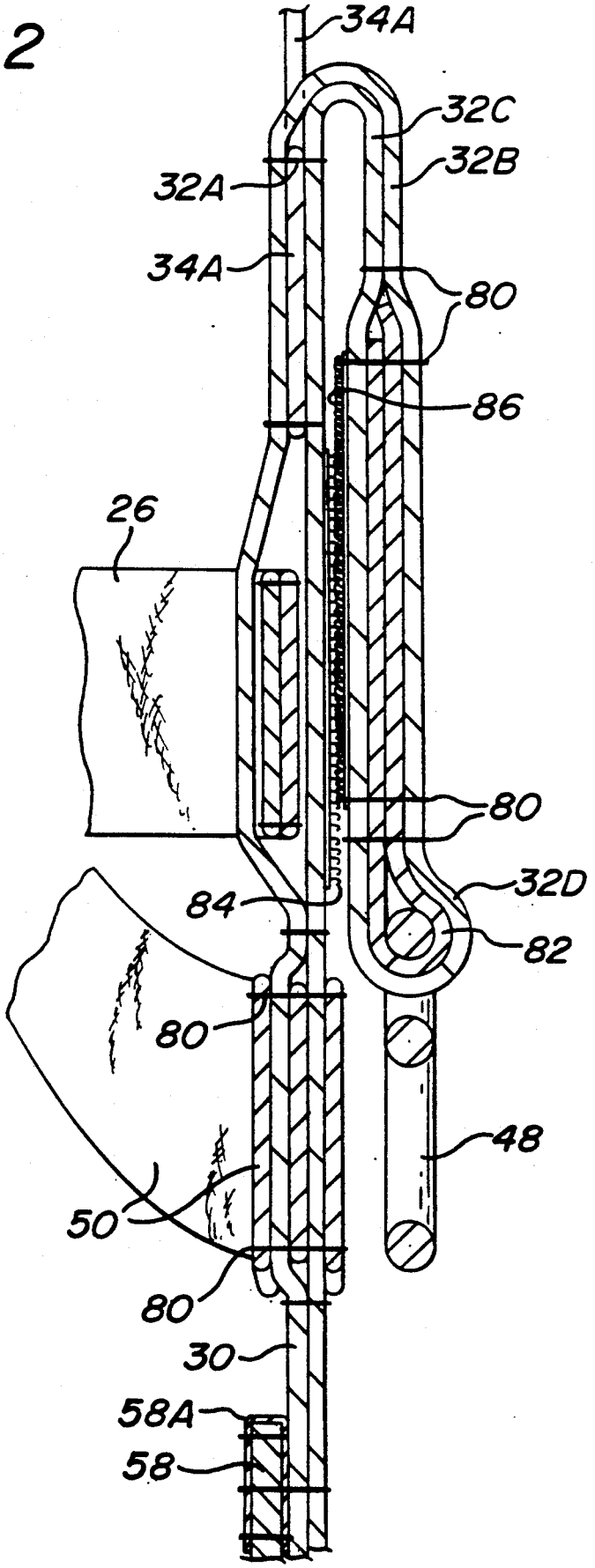
FIG. 2 is an enlarged, sectional view taken along line 2—2 of FIG. 1.

Referring now to FIGS. 1 and 2, the harness 20 comprises a plurality of flexible straps, formed of a high-strength woven plastic or other type material, such as nylon or polyester, which are fixedly secured together, such as by stitching, to form a configuration into which the upper torso and legs of a person (not shown) are held.

The harness basically comprises a pair of upper torso straps 22, a chest strap 24, a waist belt 26, a pair of leg straps 28, a seat strap 30, and a pair of support/rapelling straps 32. Each of the upper torso straps 22 include three portions, namely a chest side-strap portion 34, a shoulder strap portion 36 and a back strap portion 38. Each chest side-strap portion 34 comprises a vertically extending section arranged to extend vertically adjacent a respect side of the wearer's chest when the harness is worn. Each portion 34 is secured, e.g., sewed, at its lower end 34A to a portion 32A of an associated rapelling strap 32. The upper end 34B of each chest side-strap portion 34 terminates in a free end 34C which is folded over itself and sewn. Each free end 34C is arranged to be received within a buckle 40 secured to an associated shoulder strap portion 36, enabling the buckle 40 to adjust the chest side-strap portion 34.

Each shoulder strap portion 36 extends over a respective shoulder of the wearer and merges into an associated back strap portion 38. In fact, in accordance with the preferred embodiment of this invention, each shoulder strap portion and associated back strap portion is formed as an integral unit of a web of the flexible material.

The two back strap portions 38, extend through a cross-buckle 42, formed of any suitable strong material, such as leather or plastic, and having slots 44 therein through which the straps 38 extend and criss-cross in an X-like configuration in the center of the wearer's back, and then extend downward vertically along each side of the wearer's back. A conventional D-ring 46 is secured to the cross-buckle 42 to serve as a means for connecting the harness to some support or lowering device.

The lower end 34A of each chest side-strap portion 34 is fixedly secured, e.g., sewn, to another portion 32A of an associated rapelling strap 32. The details of the repelling straps 32 will be described later. Suffice it for now to state that each rapelling strap 32 is formed of two webs 32B and 32C (FIG. 2), each composed of the same material as that of the torso straps. The two webs 32B and 32C are sewn together along most of their length (except in a mid-portion area) to form a double thickness rapelling strap. This unsewn mid-portion of each rapelling strap forms a passageway through which a portion of the waist belt 26 passes, to secure the waist belt to the rest of the harness. As described in detail below, this feature enables the waist belt 26 to be replaced with a different style waist belt, containing a waist positioning pad, which is the embodiment shown in FIGS. 3–5 and described in further detail below.

The free end 32D of each repelling strap includes means for connecting it to some safety device, e.g., a rope grab, a lowering device, etc., by a conventional D-ring 48, which is secured at the free end 32D by folding over the free end and sewing the free end to the rapelling strap.

The two webs 32B and 32C which form the rapelling straps also serve to form other portions of the harness. In particular the web 32B, which is the outermost of the two webs, forms the heretofore identified seat strap 30, and thus extends between the two rapelling straps at the rear of the harness in order to engage the buttocks of the wearer. The other web 32C forms respective extension sections 28A of both of the leg straps 28. Each leg strap 28, also includes a short section 50 which is fixedly secured, e.g., sewn, onto another portion 52 of the rapelling strap 32. The short leg strap section 50 of each leg strap includes a buckle 54 at its free end. The extension section 28A of each leg strap is arranged to be releasably secured to the buckle 54 at the free end of the short leg strap section to form a loop encircling the upper leg of the wearer just below the groin. Thus, the end of the extension section 28A of the leg strap 28 includes a plurality of eyelets 56 therein to permit the adjustment of the size of the loop to comfortably and yet securely fit the wearer's leg.

In order to enhance comfort when the harness is worn, each leg strap includes an enlarged pad 58 formed of a plastic or other materials such as nylon, polyethylene, etc., secured, e.g., sewn, onto the inner surface of the extension section 28 so that it engages the back of the wearer's leg. The pad 58 may be bound at each of its edges by a conventional binding material 58A if desired. Thus the pad has the effect of spreading out the pressure applied by the harness on the back of the wearer's leg. The heretofore identified seat strap 30 further enhances wearer comfort by the spreading some of the pressure across the wearer's buttocks.

The chest strap 24 comprises a pair of narrow right and left sections or webs 24A and 24B, respectively, which are formed of the same material making up the other straps, and which are arranged to be releasably secured together by a buckle 60. One free end of the left section 24B is folded back over itself and sewn to form a loop 62, while the other free end of that section includes the buckle 60 fixedly secured, e.g., sewn, thereon. That buckle serves to connect the two chest strap sections 24A and 24B together. To that end, the right chest strap section 24A includes a free end 24C arranged to be received in the buckle 60. The other free end of the right chest strap section 24B is in the form of a loop (not shown), like the loop 62 of the chest strap section 24B.

The chest strap sections 24A and 24B are arranged to be slidably secured onto an associated side chest side-strap portion, to position the chest strap at any location desired by the wearer. Thus, the loop 62 in the chest strap section 24B is arranged to receive therethrough the chest side strap portion 34, while the loop in the other chest strap section 24A is arranged to receive therethrough the other chest side-strap portion 34. In order to hold the chest strap sections 24A and 24B in the desired vertical position on the chest side-strap portions 34, a pair of slidable buckles 64 are provided. In particular, one slidable buckle 64 is mounted on the chest sidestrap portion 34 on the right side, surrounding the portion of the loop 62 of the chest strap web and the portion of the chestside strap portion extending through that loop. In a similar manner, a second slidable buckle 64 is mounted on the other chest side-strap portion 34 surrounding the portion of the loop of the other chest strap web and the portion of the other side strap portion extending through that loop. As a result of this type of chest strap structure, the chest strap may be removed and replaced as desired.

The waist belt 26 has a free end 26A and a looped end 26B having secured therein a conventional buckle 66 to engage the eyelets 68 for releasable and adjustable securement of the waist belt about the wearer. The waist belt further includes a loop 70 through which the free end 26A of the belt may be retained. The waist belt 26 is releasably retained to the device 20, through a loop 72 formed in the lower portion 38B of each back strap portion 38 when the lower back strap portion 38B passes through a buckle 74 via slots 76.

The rapelling straps will now be discussed in additional detail. As shown in FIG. 1, the device 20 includes a pair of rapelling straps 32 which are movable between a stored position as shown in FIG. 2, to an extended position as shown in phantom in FIG. 1. The rapelling straps 32 are comprised of two webs, outer web 32B (which forms the seat strap) and inner web 32C (which forms the leg straps). Outermost web 32B extends between the two rapelling straps 32, at the rear of the harness in order to engage the buttocks of the wearer. Inner web 32C forms the respective extension sections 28B of both of the leg straps 28.

In the harness 20, a pair of the rapelling straps are used for both additional balance and strength. As can be seen in FIG. 2, each strap 32 has a free end 32D having a conventional D-ring 48 connected thereto, for releasable connection to a lowering means (not shown) or other apparatus. As mentioned earlier, the connector is secured to the free end 32D, by folding over the free end of each extendable strap 32, and securing it in place by stitching 80 (FIG. 2) or other conventional means. As shown in FIG. 2, each of the rapelling straps 32 may include an internally contained stiffening member 82 located adjacent the free end 32D of the straps and which is sewn into place when the D-ring is sewn onto free end 32D. This stiffening member 82 aids the user in being able to extend the straps when desired, as discussed below and may be comprised of the same material as that of webs 32C and 32B.

The extendable rapelling straps 32 include on one side of their inner web 32B, the hook component 84 of a VELCRO fastening system. The other cooperating loop component 86 of the VELCRO fastening system is secured to the front face of each of the inner webs 32B. Thus, while wearing the harness, each rapelling strap 32, can be held tightly against the harness in a normal or stowed position. This ensures that the straps do not interfere with the wearer's activities or present any tangling hazard. However, when it is desired to connect the harness 20 to a lowering device, rope or other apparatus, the two extendable rapelling straps 32 can be peeled away from the harness so that they extend therefrom but are fixedly connected to the harness at their lower end 32A. Once extended, they may be easily connected to whatever support means are desired, e.g., a lowering or rapelling device.

In addition, the device 20, may include a storage compartment or pouch 88, which comprises a pocket or bolster type construction having an upper flap 90 which is releasably secured to the bolster to insure that none of the components held within the compartment fall out. The rear of the pouch is most easily secured to the harness 20 by placing the loop 92 through the waist belt 26. The loop 92 may be secured to the rear of the pouch by conventional means such as stitching or by a closure device such as a snap closure device (not shown). Although it is preferable that the pouch 88 be secured below the waist strap 26 to minimize interference with a worker, it should be readily apparent to one skilled in the art that it may be secured in any appropriate manner and place. The flap 90 may be held in place by any releasable securement means, such as VELCRO strips. This compartment is particularly suited for storing connectors or a conventional descent lowering device, etc., but can be used to hold anything that might be desired by the user and which could fit therein.

Figure 4:
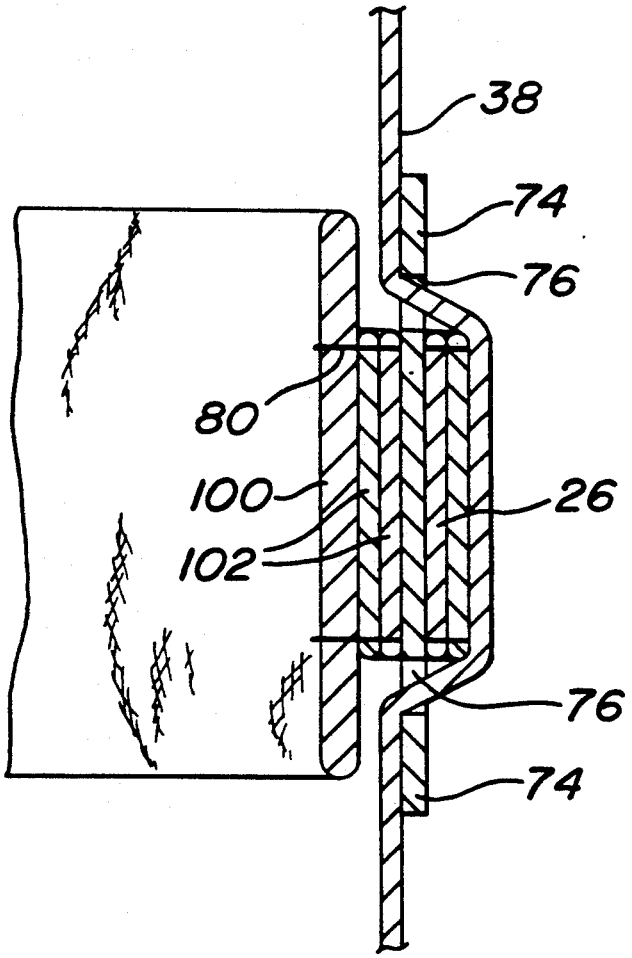
FIG. 4 is an enlarged, sectional view taken along line 4—4, of FIG. 3.
Figure 5:
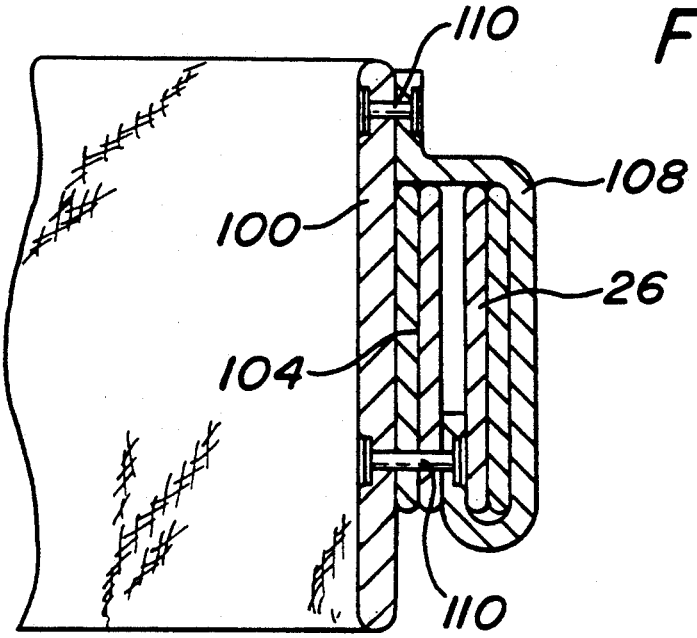
FIG. 5 is an enlarged, sectional view taken along line 5—5 of FIG. 3.

The second preferred embodiment of the present invention will now be discussed with reference to FIGS. 3-5. The harness 200 of the second embodiment is similar to harness 20, except with respect to the waist belt features which now additionally comprise a positioning pad. Common reference numerals are used with respect to common parts in both embodiments in the interest of brevity.

Figure 3:
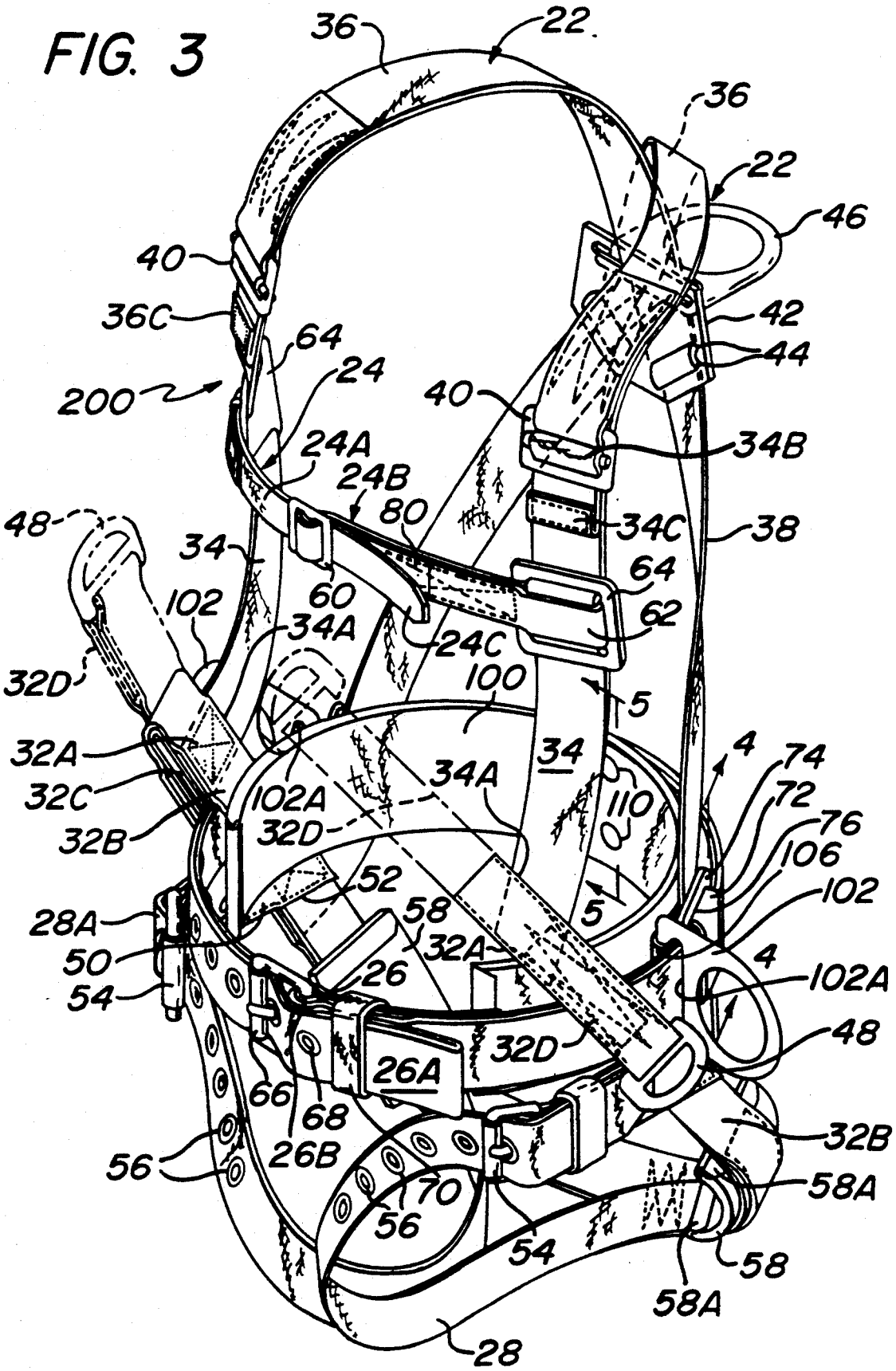
FIG. 3 is an orthogonal view of a second embodiment of a harness constructed in accordance with this invention.

As shown in FIG. 3, the harness 200 comprises the waist positioning pad 100 which is a modular unit having secured adjacent each end on the rear side thereof, a conventional D-shaped connector 102. The positioning pad 100 may be secured to the harness 200 if desired and easily removed due to its modular construction. To that end, securement of the positioning pad 100 will be discussed with respect to FIGS. 4 and 5. As shown in FIG. 4, the pad 100 is sewn onto a strip of webbing 104 which has loops 106 (FIG. 3) formed at each end when the webbing 104 is folded over and stitched to the rear of the pad. Each of these loops 106 retains the D-shaped connectors 102 therein which are in part, utilized to retain the modular positioning pad unit to the waist belt as described in detail hereinafter. The connectors are retained within the loops at the appropriate situs by the stitching 80 of the webbing 104. At approximately the center of the positioning pad 100, a loop of material 108 is riveted to the pad 100 and the webbing 104 via rivets 110 to enable the waist belt 26 to pass through and be retained by loop 108. The positioning pad structure is easily added to the overall harness structure. For example, the free end of the waist belt 26 is threaded through the unsewn mid-portion passageway of a rapelling strap 26. Thereafter the free end is threaded through the through the slot 102A of D-connector 102 (FIG. 3) located on webbing 104, through the loop 106 and thereafter through the slot of a second identical D-connector located in the loop 106 of webbing 104. Thereafter, the waist belt free end 26A is threaded through the second passageway of the second rapelling strap and may then be secured about the wearer's waist by engaging the eyelets in the waist buckle. The positioning pad more firmly places the harness about the person's waist for additional comfort and means of securement. The positioning pad also enables the distribution of the person's weight over a greater surface area to increase comfort and provide a more secure fit.

Without further elaboration the foregoing will so fully illustrate my invention that others may, by applying current or future knowledge, adapt the same for use under various conditions of service.

I claim:

1. A harness formed of a flexible material to be worn by a person, said harness including a waist belt, a pair of upper torso straps, a pair of leg straps, and a pair of rappelling straps, each of said upper torso straps including a chest strap portion for extending over a portion of the chest of the person, a shoulder strap portion for extending over a respective shoulder of the person, and a back strap portion for extending over a portion of the back of the person, each of said leg straps for extending about a respective leg of the person, each of said rappelling straps being connected to a respective one of said leg straps and to a respective one of said chest strap portions, each of said rappelling straps including an extendable portion arranged to be extended from a retracted position to an extended position for connection to a holding or lowering device, each of said rappelling straps including a passageway through which said waist belt extends.

2. The harness of claim 1 wherein said waist belt comprises means for holding at least one tool thereon.

3. The harness of claim 2 wherein each of said rappelling straps includes releasably securable means to retain it in said retracted position, until it is desired to extend such straps, whereupon such strap may be extended outward from said harness to said extended position for connection to said holding or lowering device.

4. The harness of claim 3 wherein said releasably securable means comprises cooperating hook and loop fastening means.

5. The harness of claim 2 wherein said waist belt is connected to each of said back straps by respective sliding connector means.

6. The harness of claim 5 wherein each of said sliding connector means is arranged to slide with respect to said back strap and with respect to said waist belt.

7. The harness of claim 2 wherein said means for holding a tool on said waist belt is positionable along said waist belt.

8. The harness of claim 7 additionally comprising a positioning pad for releasable securement to said waist belt.

9. The harness of claim 8 wherein said waist belt is formed of a web of flexible material, and wherein said positioning pad comprises a web of flexible material which is wider than said waist belt.

10. The harness of claim 9 wherein said positioning pad comprises a pair of D-rings fixedly secured thereto, each of said D-rings including an opening therein through which said waist belt extends to hold said positioning pad on said waist belt.

11. The harness of claim 1 wherein said waist belt is connected to each of said back straps by respective sliding connector means.

12. The harness of claim 11 wherein each of said sliding connector means is arranged to slide with respect to said back strap and with respect to said waist belt.

13. The harness of claim 1 additionally comprising a positioning pad for releasable securement to said waist belt.

14. The harness of claim 13 wherein said waist belt is formed of a web of flexible material, and wherein said positioning pad comprises a web of flexible material which is wider than said waist belt.

15. The harness of claim 14 wherein said positioning pad comprises a pair of D-rings fixedly secured thereto, each of said D-rings including an opening therein through which said waist belt extends to hold said positioning pad on said waist belt.

* * * * *